United States Patent [19]

Raczuk

[11] 4,228,868

[45] Oct. 21, 1980

[54] MUFFLER APPARATUS

[76] Inventor: Richard C. Raczuk, 19400 Singing Hills Dr., Northridge, Calif. 91324

[21] Appl. No.: 1,491

[22] Filed: Jan. 8, 1979

[51] Int. Cl.[3] ..... F01N 1/10

[52] U.S. Cl. ..... 181/247; 181/252

[58] Field of Search ..... 181/212, 247–252, 181/231, 240, 228, 256, 268, 275, 213, 227; 55/DIG. 21, DIG. 30, 276

[56] References Cited

U.S. PATENT DOCUMENTS

| | | | |
|---|---|---|---|
| 1,968,312 | 7/1931 | Rensink | 55/276 |
| 1,995,071 | 3/1935 | MacKenzie et al. | 181/256 |
| 2,543,461 | 2/1951 | Latulippe | 181/252 |
| 2,929,462 | 3/1960 | Nowak | 181/252 |
| 3,113,635 | 12/1963 | Allen et al. | 181/268 |
| 3,503,465 | 3/1970 | Kobayashi et al. | 181/252 |
| 3,905,445 | 12/1975 | Scharton | 181/213 |
| 4,045,157 | 8/1977 | Peterson | 431/114 |
| 4,113,051 | 9/1978 | Moller | 181/243 |
| 4,116,303 | 9/1978 | Trudell | 181/252 |

*Primary Examiner*—L. T. Hix
*Assistant Examiner*—Benjamin R. Fuller
*Attorney, Agent, or Firm*—Nilsson, Robbins, Dalgarn, Berliner, Carson & Wurst

[57] ABSTRACT

A muffler apparatus has an outer housing for being attached to a motorcycle or the like. Disposed internally of the housing is a passageway assembly having a connecting tube with a flare for being connected to an exhaust pipe and a perforated tube connected to the connecting tube. A solid tube, opened at both of its ends, is rigidly affixed to the interior of the perforated tube in concentric relationship. The solid tube extends through at least a portion of the length of the perforated tube. Alternatively, several solid tubes in either clustered or concentric arrangements may be used in place of the single solid tube.

8 Claims, 4 Drawing Figures

MUFFLER APPARATUS

BACKGROUND OF THE INVENTION

The present invention relates to a muffler apparatus and in particular to an improved muffler apparatus having a solid, open-ended tubular structure in the intake or exhaust passageways.

Preventing, decreasing or otherwise mitigating various types of pollution has become increasingly important, particularly in high population areas. One type of pollution which has received increasing attention is high levels of noise which often create high levels of anxiety and annoyance, and may even cause physical harm.

Engines, and in particular, internal combustion engines, constitute a major source of high noise levels. Consequently, various muffler devices have been developed for both the intake and exhaust passageways. While these devices have succeeded in substantially reducing the noise level from engines, it is desired to reduce the noise levels even further. The present invention achieves such a decrease in noise levels by affixing at least one open-ended, non-perforated, tube in the flow path of a conventional muffler arrangement where the flow path is generally defined by a perforated cylinder or tube. In the preferred embodiment of the present invention, the non-perforated or solid tube is concentrically positioned in the interior of the perforated tube.

Several previous patents for muffling devices have incorporated concentric tubular structures. For example, in U.S. Pat. No. 3,503,465 issued on Mar. 31, 1970, to Shunji Kobayashi et al, outer, intermediate and inner hollow truncated cone structures concentrically interconnected with specific divergent angles in the discharge direction are shown. Sound absorbing layers of specific thickness are provided on at least one surface of each cone structure.

More specifically, and with reference, by way of example, to FIG. 5 of that patent, the outer truncated cone member comprises a housing which supports internally thereof a pair of conically shaped diverging tubes. The innermost tube is both perforated and filled with a sound absorbing material. Consequently, it is not opened at both of its ends to provide an unobstructed path through the center of the tube and is not a solid tube as disclosed by the present application. In addition, while the intermediate tube is constructed of solid non-perforated sheet metal, the above-identified patent requires that the intermediate conical tube have a sound-absorbing material affixed on either one or both of its sides. Such sound-absorbing material is not required in the present invention. Furthermore, as described herein, the present invention utilizes a non-conical tube having a constant cross-sectional area along its length. Finally, the solid outer or housing tube also requires that a sound-absorbing layer of material be affixed to its inner surface. As described in the above patent, each of the sound-absorbing layers is held to the corresponding support tube by a perforated layer of sheet metal.

Thus, the above-described patent involves a complex multi-layer structure requiring not only that the inner concentric tubes be conically shaped but further requiring multiple layers of soundabsorbing material. By contrast, the present invention involves a simple tubular structure which is preferably concentrically positioned in the interior of the perforated tube so that the central axis of the solid tube is coincident with the central axis of the perforated tube or cylinder defining the flow path. The structure is surrounded and supported by a solid housing which may be cylindrically shaped or may be conically shaped.

In U.S. Pat. No. 1,968,312 entitled "Air Cleaner and Silencer" issued in 1934 to G. C. Rensink, a muffler device is disclosed comprising an air-intake apparatus adapted to be connected to a carburetor or the like and includes a solid tube which is mounted internally of a perforated tube with the combination being surrounded by a sound-absorbing material and placed within a housing. However, in that patent, the perforated tube is closed at both of its ends requiring that the flow path of gases be lateral to the longitudinal axis of the perforated tube. Consequently, the gas must flow from the outside, laterally through the sound-absorbing material, through the perforations in the perforated tube, and then longitudinally down through the solid tube. By contrast, the flow path of gases in the present invention is always along the longitudinal axis of the perforated tube. Furthermore, the gases are not permitted to flow through the perforations and sound-absorbing material either from or to the outside.

In U.S. Pat. No. 1,995,071 granted to R. J. MacKenzie et al, a silencer device is provided with a sold tube concentrically positioned internally of a perforated tube which is positioned inside a housing. However, the solid tube is not opened at both ends. Consequently, there is no continuous and unobstructed passageway through the solid tube.

In U.S. Pat. No. 4,045,157, issued on Aug. 30, 1977, to Peterson, a silencer device is disclosed having a plurality of axially disposed tubes adapted to be connected to the air intake orifice of an industrial burner. Although the specific structure disclosed includes a solid tube which is disposed axially of a perforated tube used as part of the muffler apparatus, the solid tube is specifically disclosed as being a viewing tube which is normally closed by a member identified by the reference numeral 30 in FIG. 2 of that patent.

Consequently, by contrast to the above-described references, the present invention provides a simple structural modification in a conventional muffler having an unobstructed passageway defined by a perforated tube or other cylindrical structure. This modification comprises a solid tube, opened at both of its ends to provide an unobstructed pathway therethrough, disposed internally of the perforated tube structure so that gases pass not only through the passageway defined by the solid tube but through the passageway defined by the region between the internal surface of the perforated tube and the external surface of the solid tube.

Although the specific physical principles which operate to cause a reduction in noise levels are unknown, tests have demonstrated that the present invention results in a noise level reduction in a Kawasaki 1000 motorcycle of approximately five decibels when compared to the same motorcycle without the present invention. Furthermore, it has been found that when the present invention is used in the exhaust passageway, the pollution content of the exhaust gases is also substantially reduced. Finally, it will be appreciated that several open-ended solid tubes may be utilized and may be positioned in either a cluster or concentric arrangement in accordance with the present invention.

SUMMARY OF THE INVENTION

The muffler device of the present invention is adapted to be coupled to either an intake or exhaust passageway of a noise source such as an internal-combustion engine. Specifically, the muffler comprises a housing having one of its ends coupled to the noise source and its other end opened to either intake or exhaust gases. A perforated tube is positioned to extend through the internal region of housing for defining a gas flow path therethrough. The perforated tube is coupled at one of its ends to the gas passageway of the noise source and is opened at its other end. At least one solid tube, opened at both of its ends, is positioned internal to the perforated tube so that the cross-sectional area of the flow path defined by the perforated tube is substantially unchanged by the solid tube. Thus, a continuous unobstructed passageway both through the solid tube and between the solid tube and the inside surface of the perforated tube is provided to allow the passage of gas therethrough.

Yet another advantage of the present invention is that less energy is dissipated in the muffler which allows a motorcycle to accelerate fasther. For example, in one test, a motorcycle equipped with the invention was able to go through a quarter of a mile in about one-half second less than the same motorcycle equipped with a muffler without the invention but otherwise identical.

In a preferred embodiment, the perforated tube and the solid tube internal thereto are concentrically positioned having a common longitudinal central axis. In one embodiment of the present invention, a single solid tube is utilized although it will be appreciated that two or more concentrically positioned tubes may be utilized in place of the single tube.

The solid tubes may be positioned in the perforated tube by a plurality of attachment rods between the inside surface of the perforated tube and outside surface of the solid tube. A similar attachment means may be provided for the embodiments utilizing multiple solid tubes.

BRIEF DESCRIPTION OF THE DRAWINGS

The invention will be better understood from the detailed description below taken in conjunction with the drawings wherein like reference characters refer to like parts throughout and in which.

DETAILED DESCRIPTION

Figure 1:
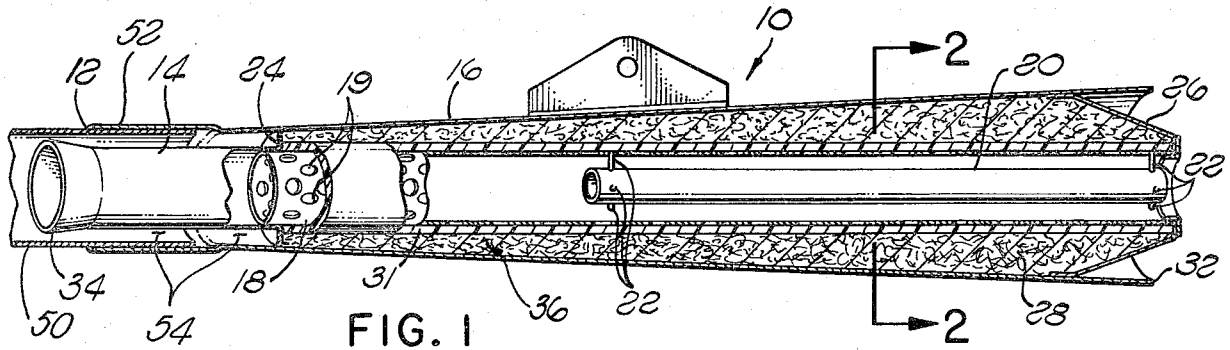
FIG. 1 is a cut-away perspective of a muffler apparatus in accordance with the present invention.

Referring first to FIG. 1, a novel muffling apparatus 10 is illustrated having a housing 16 which may be of a generally cylindrical or conical shape having a connecting sleeve 52 at a first end 12. The exhaust gases then pass through the muffling apparatus and exit from a second end 32. The muffling apparatus 10 is attached to an exhaust pipe 50 by press fitting the connecting sleeve 52 around the exhaust pipe 50. A muffling extension 14 is attached to a perforated tube 18 which extends substantially through the remainder of the housing 16 terminating generally at the second end 32 of the housing 16.

In one embodiment, the muffling extension 14 has a generally conical end portion 34 of increasing diameter which protrudes into the exhaust pipe 50. The muffling extension does not touch the inside surface of the exhaust pipe. The region 54 between the outside of the muffler defined by the housing 16, the connecting sleeve 52 and the end of the exhaust pipe 50, and the muffling extension 14 thus defines a chamber having only one end through which exhaust gases which enter must also exit.

Figure 2:
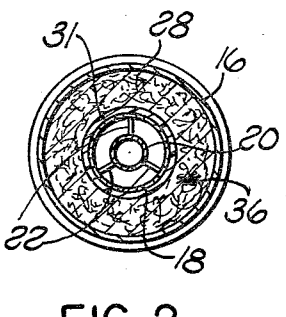
FIG. 2 is a cross-sectional plan view through section 2—2 of FIG. 1.

It is believed that the chamber 54 aids in decreasing both the noise and pollution levels. An even greater decrease in noise and pollution levels results if the end of the muffling extension is conical as illustrated in FIGS. 1 and 2. It will be appreciated, however, that a non-conical end of the muffling extension may be used in accordance with the invention.

Because gases may exist in but do not pass through the chamber 54, the muffling extension 14 and the perforated tube 18 define the path along which exhaust gases pass prior to their expulsion from the second end 32 of the muffler apparatus 10.

In the preferred embodiment, a cylindrical passageway assembly, defined by the muffling extension 14 and the perforated tube 18, is concentrically attached to extend through the housing 16 so that the central axis of the cylindrical passageway assembly is coincident with the central axis of the housing 16. As shown in FIG. 1, the concentric positioning of the passageway assembly may be accomplished by providing an axially disposed first flange 24 which is attached between the outside surface of the muffling extension 14 and the inside surface of the housing 16. The flange 24 is preferably solid for preventing gases from passing through the chamber 54 and entering the region around the perforated tube 18 without first passing through the perforations 19.

A second end or flange member 26 is provided at the second end 32 of the muffler assembly 10 to interconnect the perforated tube 18 to the interior surface of the housing 16 in concentric orientation. The flange member 26 is also solid to prevent the passage of any gas through the region between the exterior surface of the passageway assembly and the interior surface of the housing 16.

A chamber 36, defined as the region between the interior surface of the housing 16 and the exertior surface of the perforated tube 18 between the first flange 24 and the second flange 26, is preferably filled with insulating material. For example, in a preferred embodiment, the perforated tube 18 is first wrapped with one layer of jet glass 31, similar to that used in the inside of jet engines. The space between the housing 16 and the layer of jet glass is then packed with cerewool 28, which is the ceramic based fiber glass utilized in hot water heaters and the like. Thus, gases pass through the passageway defined by the passageway assembly and both enter and exit the chamber 36 only through the perforations 19 in the perforated tube 18. The cerewool 28 is retained in the chamber 36 by the layer of jet glass 31 so that the cerewool 28 does not pass through the perforations in the perforated tube 18.

In accordance with the present invention, a significant decrease in noise level may be achieved by attaching an open ended, non-perforated or solid tube 20 longitudinally along the interior of the perforated tube 18. In the preferred embodiment, the solid tube 20 will also be concentric with the perforated tube. Thus, in FIG. 1, the solid tube 20, having an outside diameter smaller than the inside diameter of the perforated tubing 18, is longitudinally and concentrically positioned along at least a portion of the passageway defined by the perforated tube 18. A plurality of rods 22, at various positions along the length of the solid tube 20, may be utilized to interconnect the outside surface of the solid tube 20 to the inside surface of the perforated tube 18. For example, the rods 22 may simply be welded between the inside surface of the perforated tube 18 and the outside surface of the solid tube 20 or may, in an alternative arrangement, be a bolt or screw assembly. Of course, any other means for connecting the solid tube in the passageway defined by the perforated tubing may be utilized.

Because the solid tube 20 is opened at both of its ends and is positioned longitudinally along the length of the passageway defined by the perforated tube 18, the cross-sectional area of the passageway through which the exhaust gas flows will be substantially the same along the length of the passageway. Consequently, the solid tube 20 provides a minimal obstruction in the direction of gas flow since gas is allowed to flow longitudinally both around and through the solid tube.

It will be appreciated that while FIG. 1 illustrates a solid tube 20 extending only partially along the length of the passageway defined by the perforated tube 18, the solid tube 20 may be provided to extend the entire length of the passageway defined by the perforated tube 18 without departing from the spirit of the present invention.

Referring to FIG. 2, a cross-section of the muffler assembly through section 2—2 of FIG. 1 is illustrated showing the preferred concentric arrangement of the housing 16, the perforated tube 18 and the solid tube 20. In FIG. 2, the solid tube is attached to the perforated tube 18 by three equiangularly spaced coupling rods 22 connected between the outside surface of the solid tube 20 and the inside surface of the perforated tube 18. It will be appreciated that while the above-described concentric arrangement is preferred, the solid tube 20 may be positioned at any non-concentric location so long as the central axis of the solid tube 20 is at least parallel to the central axis of the perforated tube 18. In addition; two or more solid tubes may be clustered so long as the central axis of the various clustered solid tubes are substantially parallel to the central axis of the perforated tube 18.

Figure 4:
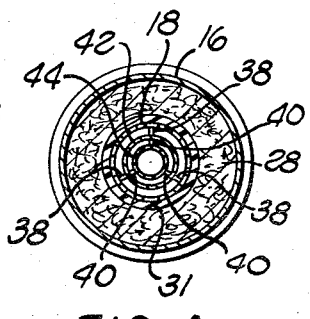
FIG. 4 is a cross-sectional plan view through section 4—4 of FIG. 3.
Figure 3:
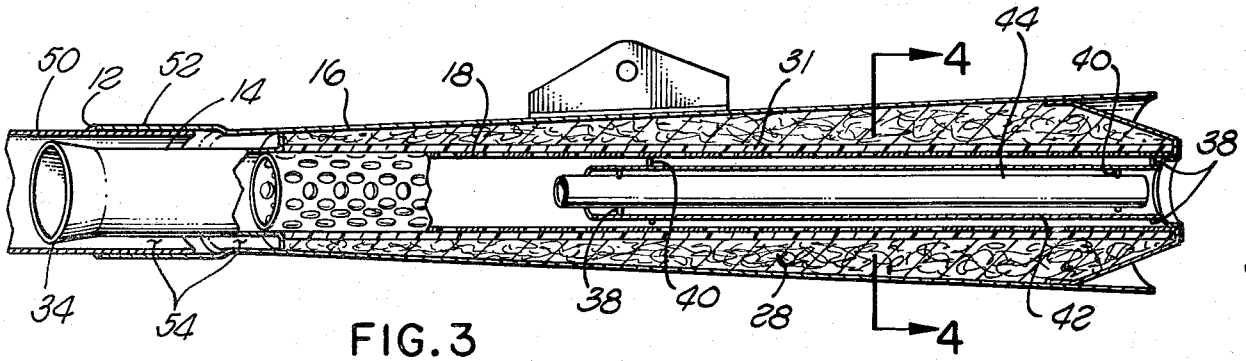
FIG. 3 is a cut-away perspective view of a muffler in accordance with the present invention showing two concentrically attached solid tubes.

Referring to FIG. 3, another embodiment of the present invention is illustrated incorporating a solid tube assembly comprising two concentrically attached tubes. Thus, in place of the single solid tube 20 connected by the rods 22 illustrated in FIG. 1 and FIG. 2, a solid tube assembly is provided comprising a first solid tube 44, concentrically interconnected by a plurality of coupling rods 40 to a second solid tube 42 which is similarly concentrically interconnected to the perforated tube 18 by a plurality of coupling rods 38. A cross-section through section 4—4 of FIG. 3 is illustrated in FIG. 4 to show the relative positioning of the first solid tube 44, the second solid tube 42, the perforated tube 18, and the housing 16 as well as the plurality of coupling rods 38 and 40.

As previously described in conjunction with FIGS. 1 and 2, the first solid tube 44 may be replaced by a cluster of tubes each having an axis parallel to the central axis of the perforated tube 18. In addition, while it is preferable to have the solid tubes and the perforated tube in concentric positions whereby the central axis of the first solid tube 44, second solid tube 42 and the perforated tube 18 are coincident, such concentricity is not essential to the present invention.

Various other modifications and arrangements in accordance with the present invention will be obvious in view of the above disclosure and such specific illustrative embodiments described herein are intended to be merely illustrative of the present invention and not limiting.

What I claim is:

1. A muffler having an entrance port and an exit port for being coupled to a source of noise having a gas passageway member through which gas flows, the muffler comprising:

a housing for being coupled at one of its ends to the gas passageway member;

a perforated tube attached to the interior of the housing for interiorly of the perforated tube a first straight unobstructed passageway through the housing; and at least one solid non-perforated tube, each nonperforated tube opened at both of its ends for defining a second straight unobstructed passageway through the nonperforated tube, the non-perforated tube being positioned longitudinally in the first straight unobstructed passageway whereby the gas flows freely without substantial obstruction through both the first and second unobstructed passageways between the entrance and exit ports of the muffler.

2. The muffler of claim 1 wherein the perforated tube and the non-perforated tubes are concentrically positioned for having coincident central axes.

3. The muffler of claim 1 wherein the perforated tube and the non-perforated tubes have non-coincident, parallel longitudinal central axes.

4. The muffler of claim 1 wherein the at least one non-perforated tube comprises first and second non-perforated tubes nested concentrically inside the muffler in the first unobstructed passageway whereby the first non-perforated tube, the second non-perforated tube and the perforated tube have coincident central axes.

5. An improved muffling device between an entrance port and an exit port having interiorly a substantially straight first unobstructed gas passageway through which a gas flows for muffling the sound generated by a source of noise, the improvement comprising at least one open-ended solid, non-perforated tube longitudinally attached in the interior of the first unobstructed gas passageway, each a non-perforated tube having a substantially straight second unobstructed gas passageway therethrough whereby the gas flows freely without substantial obstruction through both the first and second unobstructed gas passageways between the entrance and exit ports of the muffler device.

6. The muffling device of claim 5 wherein the non-perforated tubes and the first unobstructed gas passageway have coincident central axes.

7. The muffling device of claim 5 wherein the at least one non-perforated tube comprises first and second non-perforated tubes nested concentrically inside the muffling device in the first unobstructed gas passageway whereby the first non-perforated tube, the second non-perforated tube and the first unobstructed gas passageway have coincident central axes.

8. The muffling device of claim 5 wherein the non-perforated tubes and the first unobstructed gas passageway have non-coincident parallel central axes.

* * * * *